US005622599A

United States Patent [19]

Sproule et al.

[11] Patent Number: 5,622,599

[45] Date of Patent: Apr. 22, 1997

[54] METHOD AND APPARATUS FOR COATING PULP PRODUCTS

[76] Inventors: Barry Sproule, Lot 7, Concession 6, East Flamborough, Ontario, Canada, L0R 2H0; Marian Corak, 25 June Wood Cr., Brampton, Ontario, Canada, L6S 3T5; Nick Saltarelli, 134 Cambridge Avenue, Iroquois Falls, Ontario, Canada, P0K 1E0

[21] Appl. No.: 266,773

[22] Filed: Jun. 28, 1994

[51] Int. Cl.[6] ..... D21F 11/00; B05D 1/02

[52] U.S. Cl. ..... 162/186; 162/119; 162/184; 162/265; 162/363; 118/300; 118/313; 118/324; 118/325; 427/475; 427/479; 427/449

[58] Field of Search ..... 162/265, 118, 162/119, 185, 186, 184, 363; 106/118, 15; 118/300, 313, 324, 325; 427/475, 479, 449

[56] References Cited

U.S. PATENT DOCUMENTS

| | | | |
|---|---|---|---|
| 1,662,641 | 3/1928 | Hans . | |
| 1,964,567 | 6/1934 | Feeney . | |
| 2,062,563 | 12/1936 | Fair | 162/186 |
| 2,112,540 | 3/1938 | McAndrews et al. . | |
| 2,309,089 | 1/1943 | Bauer et al. . | |
| 2,373,914 | 4/1945 | Quinn . | |
| 2,875,044 | 2/1959 | Dunn et al. . | |
| 3,016,876 | 10/1962 | Sedlacsik, Jr. | 427/479 |
| 3,056,718 | 10/1962 | Grissom et al. . | |
| 3,269,888 | 8/1966 | Yang . | |
| 3,287,207 | 11/1966 | Treat . | |
| 3,556,931 | 1/1971 | Champaigne . | |
| 3,560,334 | 2/1971 | Arledter . | |
| 3,919,042 | 11/1975 | Spiller | 162/175 |
| 3,948,721 | 4/1976 | Winheim | 162/119 |
| 3,950,219 | 4/1976 | Levesque . | |
| 4,062,721 | 12/1977 | Guyer et al. . | |
| 4,944,960 | 7/1990 | Sundholm et al. | 118/325 |
| 5,308,658 | 5/1994 | Morris | 427/421 |

OTHER PUBLICATIONS

Excerpt from Binks Manufacturing Co. Brochure.

*Primary Examiner*—W. Gary Jones
*Assistant Examiner*—Jose S. Fortuna

[57] ABSTRACT

A method of applying a film of coating material to a web of pulp product on a machine and an apparatus for carrying out the method. The coating material is directed in a fluid against the surface of a web of pulp product in the form of a high volume low velocity atomized spray mist from high volume low pressure spray nozzles with an exiting air pressure from the spray nozzle of 1 to 10 psig, preferably 3 to 6 psig.

23 Claims, 4 Drawing Sheets

METHOD AND APPARATUS FOR COATING PULP PRODUCTS

FIELD OF THE INVENTION

The invention relates generally to a method and apparatus for applying a film of coating material to a web of pulp product in a paper or board machine. In the method of the invention, the coating material is directed against the surface of the web of pulp product in the form of a high volume low velocity atomized spray mist. The apparatus is equipped with a plurality of high volume low pressure spray guns supported adjacent to the web of pulp product for providing a high volume low velocity atomized spray mist of coating material.

BACKGROUND OF THE INVENTION

Pulp products, such as paper and board are manufactured commercially on large scale machines, such as fourdrinier, double wire and cylinder machines. In the manufacturing process, pulp stock, containing fibres such as wood pulp, rag or recycled paper fibres, along with suitable additives such as fillers, retention aids, pigments, flocculating agents, defoaming agents or binders in large volumes of water, are mixed to a slurry.

Fourdrinier, double wire and cylinder machines are equipped with different screens in the forming section of the machine. The fourdrinier machine has an endless moving fourdrinier wire screen, double wire machines have two endless wire screens and the cylinder machines have cylindrical revolving screens.

In a fourdrinier machine, the slurry of pulp stock is fed from a head box onto the continuously moving fourdrinier wire in the forming section of the machine. As the slurry advances on the wire down the forming section of the machine an initial amount of the water in the pulp stock drains through the wire into drainage units to form a web of pulp product supported on the wire. Close to the downstream end of the wire additional amounts of water are forcibly removed from the web by means of suction boxes in contact with the lower surface of the wire.

Once the web of pulp product reaches the end of the wire it is passed over a suction couch roll which extracts further water from the web of pulp product which emerges from the couch roll as a self supporting web of pulp product which can be peeled off the wire and subjected to further processing steps, such as pressing, drying and calendering to remove water and improve the surface and finish of the product.

For some applications, in particular for printing applications, such as light weight coated and machine finished coated paper it is desirable to apply a coating to the pulp product. Such coating is traditionally applied to both surfaces of the dry paper sheet in a size press, which generally consists of a pair of rolls with loading capability, forming a nip, through which the sheet passes. The coating material is applied to the surface of the rolls by a dip roll or spray pipes so that the ingoing nip is flooded with the coating material, thereby impregnating both surfaces of the sheet. Coating materials include starch sizing, filler, pigment and binder.

The conventional size press has a number of disadvantages and size press operation reduces overall machine efficiency. Size presses have a large number of moving parts that wear and require adjustment and they are labour intensive in terms of both general maintenance and time in equipment clean-up.

There are many machines operating today, such as groundwood type machines for newsprint, which do not include size presses because, traditionally, the paper run on these machines was not coated. It is desirable in some cases to add coating capability to these machines in response to changing demands in the paper industry for different types and grades of paper.

It can be both time consuming and costly to undertake the extensive alterations required to add conventional coating systems. In most cases, to apply a uniform surface coating would require the addition of a size press, roll coater, etc. This type of coating applicator would require more space than is available on typical newsprint type machines. Drying capacity would have to be increased because of additional moisture added to the pulp product at the size press. In most cases, this would require increasing the length of the machine which in turn, would see the calender, reel and, possibly, the winder relocated.

Sprays have been used to impregnate modifying agents and additives substantially throughout the thickness of a forming paper web (U.S. Pat. No. 2,112,540 to McAndrews). Spray systems have very few moving parts and require little maintenance. Such sprays are generally located upstream from the suction boxes so that the modifying agent or additive is dispersed throughout the wet web (U.S. Pat. No. 2,112,540 to McAndrews and No. 3,287,207 to Treat). Dispersing agents have been used to facilitate incorporation of the additive into the web, U.S. Pat. No. 3,560,334 to Arledter.

In order to eliminate the problems of coating dried pulp products, attempts have been made to apply coating materials to the web of pulp product in the forming section of the machine before it passes over the suction couch roll and is removed from the forming section as a self supporting web of pulp product and is fed into the presses and dryers. Processes used to spray fillers and additives are described, for example, in U.S. Pat. No. 2,373,914 to Quinn.

There are a number of problems associated with the use of spray systems for applying coating materials to a web of pulp product in a machine and it has not been possible to obtain an even, complete coverage at machine speeds.

Traditionally, in the pulp and paper industry coating material is sprayed by pressure type nozzles which employ the fluid pressure to disperse the fluid, creating large droplets of liquid, resulting in spotty coverage of the web. Typical spray systems used in the industry propel the fluid at a high velocity, generating sufficient force to cause a ricochet effect when the fluid impacts on the web resulting in a spotty uneven finish. With typical high pressure application, the centre of the stream is more concentrated causing streaks on the coated surface while the outer edges of the spray fan are lost to the atmosphere, with a typical transfer efficiency of less than 50% The outer edges of the fan may also dry before reaching the substrate, contributing to the poor transfer efficiency. The poor transfer efficiency may also contribute to equipment contamination as overspray is carried in the air and may be deposited on any surface that it may come into contact with, thereby contaminating the equipment and work environment.

Accordingly, there is a need for a simple, flexible and efficient method for applying a film of coating material to a web of pulp product on a machine.

SUMMARY OF THE INVENTION

It is an object of the invention to provide an efficient method for applying a film of coating material to a web of pulp product on a machine. It is a further object of the invention to provide a method which deposits coating material onto the web of pulp product with a high transfer efficiency, thereby reducing contamination of the surrounding equipment and environment. A still further object is to provide an apparatus for applying a film of coating material to a web of pulp product on a machine, which is simple, inexpensive and which can be readily adapted to an existing machine for installation with minimal modifications.

A yet further object is to provide a method and apparatus which are flexible and which may be readily adapted for coating one or both sides of the web of pulp product, to permit the manufacture of a range of products for a variety of applications.

The present inventors have, surprisingly, determined that high volume low pressure spray guns provide a uniform film of coating to a web of pulp product on a machine. A high volume low velocity atomized spray is applied by the high volume low pressure spray guns positioned adjacent to the web of pulp product.

In accordance with an aspect of the invention there is provided a method of applying a film of coating material to a web of pulp product on a machine having a screen for forming a web of pulp product comprising the steps of: depositing a slurry of pulp stock on the screen of the forming section of the machine; draining an initial amount of water through the screen, thereby forming the slurry of pulp stock into a web of pulp product on the screen and; directing a fluid comprising the coating material against the surface of the web of pulp product in the form of a high volume low velocity atomized spray mist, whereby a film of coating material is deposited on the web of pulp product in the machine.

In an embodiment of the method, the pulp product is paper. The method is particularly suited for applying a film of coating material to lightweight paper for printing applications. In other embodiments the pulp product is newsprint or paper board.

In an embodiment of the method, the film of coating material is applied to the web of pulp product in the forming section of a machine whereby, the film of coating material is deposited on the web while the web is supported on the screen in the forming section of the machine. Suction to remove further water from the web of pulp product on the screen may be applied simultaneously with the atomized spray mist of coating material. Suction may also be applied prior to the application of the atomized spray mist of coating material.

In an embodiment of the method of the invention, the atomized spray mist consists essentially of droplets in the size range of from 1 to 1200 micrometres, preferably 1 to 200 micrometres. Preferably, the coating material is applied to the web of paper with a transfer efficiency of over 70 percent, preferably over 90 percent, more preferably in the range of from 90 to 100 per cent. The screen may be a fourdrinier wire, one or both of the double wires, or a cylinder screen for example.

In a further embodiment, the film of coating may be applied to the web of .pulp product in the machine downstream from the forming section. In this case, prior to application of the atomized spray mist of coating material, the web of pulp product may be further treated by applying suction to remove further water from the web of pulp product on the screen; passing the web of pulp product over a suction couch roll and; peeling the web of pulp product off the screen. The web of pulp product may also be still further pretreated by pressing the peeled web in a press prior to applying the atomized spray mist of coating material.

In a preferred embodiment, the high volume low velocity atomized spray mist is provided by at least one high volume low pressure spray gun, which can transfer the coating material to the web of pulp product with a transfer efficiency of greater than 70 per cent, preferably over 90 per cent, more preferably in the range of from 90 to 100 per cent. The high volume low pressure spray guns may have an exiting air pressure from the spray nozzle tip of from about 0.1 to 10 psig, preferably 3 to 6 psig.

The fluid comprising the coating material may be water or an organic solvent with one or more coating materials in suspension or solution. The fluid may contain from about 0.1 to 50 percent solids, preferably 5 to 30 percent. Suitable coating materials are well known in the paper making art and include starch (modified and unmodified), clay, mineral pigment, organic pigment, dye or fluorocarbon, latex, polyvinyl alcohol, polymers etc.

In an embodiment of the invention, the coating material is applied to a web of paper moving through the atomized spray mist at a speed of from about 400 to 5,000 fpm, preferably 800 to 2,200 fpm.

In accordance with another aspect of the invention, there is provided an apparatus for applying a film of coating material to a web of pulp product on a machine equipped with a forming section having a screen for forming a web of pulp product, comprising: means for depositing a slurry of pulp stock on the screen in the forming section of the machine; drainage means for raining an initial amount of water through the screen to form the slurry of pulp stock into a web of pulp product; a plurality of high volume low pressure spray guns positioned adjacent to the web of pulp product for directing a fluid comprising the coating material against the surface of the web of pulp product in the form of a high volume low velocity atomized spray mist to deposit a film of coating material on the web of pulp product.

A further aspect of the invention relates to an apparatus for applying a film of coating material to a moving web of pulp product on a machine, the apparatus comprising: support means positioned on the machine adjacent to the web of pulp product and extending across the width of the web of pulp product; a plurality of high volume low pressure spray guns positioned on the support means for providing a high volume low velocity atomized spray mist of coating material to the web of pulp product; an air source connected to the plurality of spray guns for supplying air to the spray guns and; means for supplying fluid coating material to the spray guns.

In an embodiment, the support means comprises a spray boom supporting the plurality of spray guns in alignment transverse to the direction of movement of the web of pulp product. Preferably, the spray guns have an exiting air pressure from the spray nozzle tip of from about 0.1 to 10 psig, most preferably, of from about 3 to 6 psig.

The spray guns may be supported in a plane such that the guns are positioned at a distance of from 1 to 24 inches preferably from 4 to 10 inches, most preferably about 5 to 7 inches from the web of pulp product. Preferably, the spray guns are supported above the web of pulp product at a position from about the downstream end of the drainage units to just upstream of the suction couch roll. The spray guns may also be supported above or below the self supporting web of pulp product peeled off the screen downstream of the forming section of the machine.

DESCRIPTION OF THE DRAWINGS

The invention will be better understood with reference to the drawings in which.

DETAILED DESCRIPTION OF THE INVENTION

Figure 1:
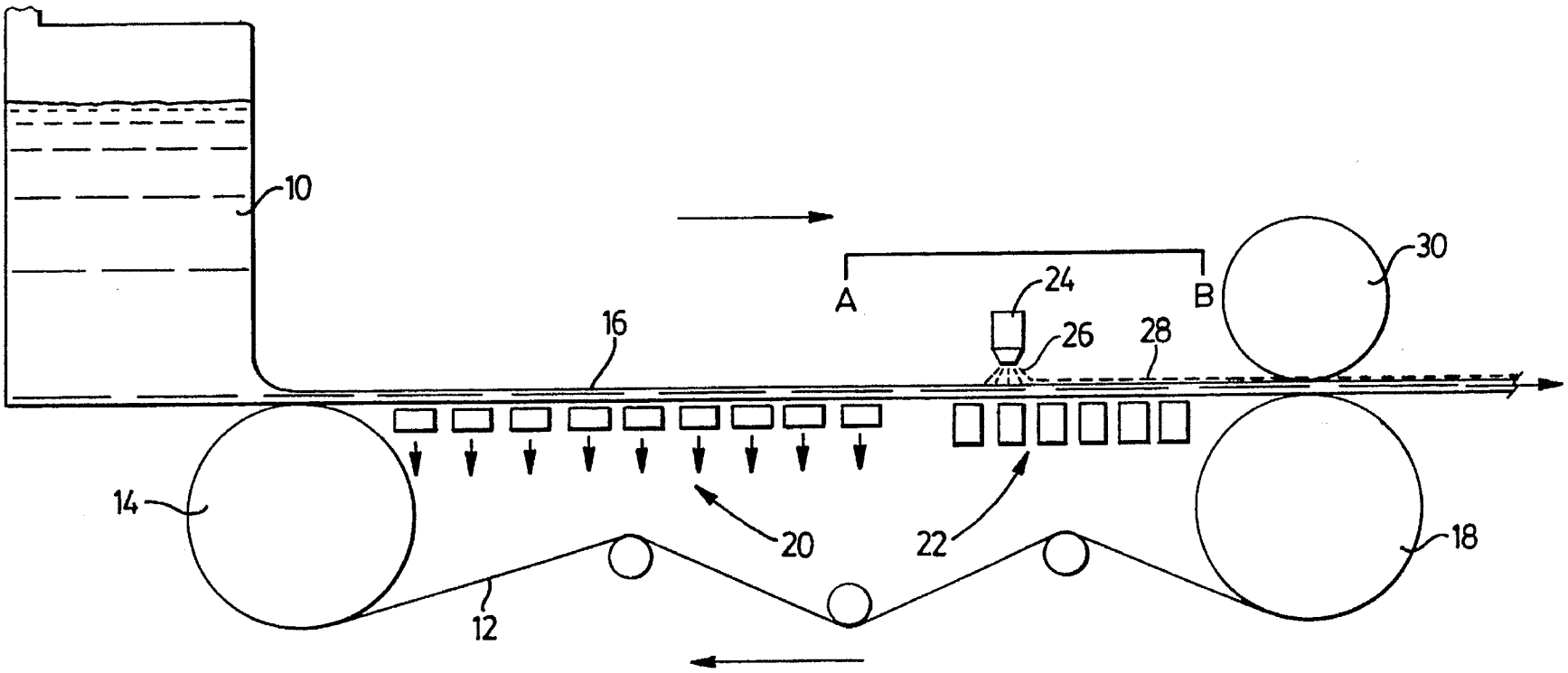
FIG. 1 is a schematic drawing of the forming section of a typical fourdrinier machine showing the position of the high volume low velocity atomized mist spray of an embodiment of the invention.

Referring now to the drawings in detail, which illustrate embodiments of the invention, wherein like reference characters indicate like parts throughout the figures. FIG. 1 schematically depicts the fourdrinier wire portion of a typical endless wire machine. It will be appreciated that the present invention is by no means restricted to fourdrinier machines as shown in the illustrated embodiments, but is also suitable for use with other machines such as double wire and cylinder machines.

In FIG. 1 reference numeral 10 depicts the head box where the pulp stock stream is converted to a thin uniform machine width flow to deposit an even layer of pulp stock across the width of fourdrinier wire 12. The fourdrinier wire 12 moves over the breast roll 14 and carries the web of pulp product 16 downstream towards the suction couch roll 18 in the direction illustrated by the large arrow in FIG. 1. In the upstream portion of the fourdrinier wire, an initial amount of water is drained out of the stock by gravity and through the wire into the drainage units 20. The web of paper then passes over suction boxes 22 where vacuum is applied to the undersurface of the wire to remove a large proportion of the water remaining in the web of pulp product.

A plurality of high volume low pressure spray guns 24 for supplying a high volume low velocity atomized spray mist of coating material 26 are supported adjacent to the wire 12. It will be appreciated that the plurality of spray guns may be substituted by a single gun having an elongate slot nozzle for delivery of the atomized spray mist. The plurality of guns may be positioned adjacent the wire in a range of positions, preferably from the downstream end of the drainage units, designated A in FIG. 1, to a position just in front of the suction couch roll 18, designated B in FIG. 1. The high volume low pressure spray guns 24 may be positioned above the wire at a height of from 1 to 24, preferably 4 to 10, most preferably about 5 to 7, inches above the wire.

The atomized spray mist 26 deposits a film of coating material 28 across the surface of the web of pulp product, which then passes between the suction couch roll 18 and the lump breaker 30 after which it is peeled from the wire as a self supporting web of pulp product which passes downstream to the presses and dryers.

Figure 2:
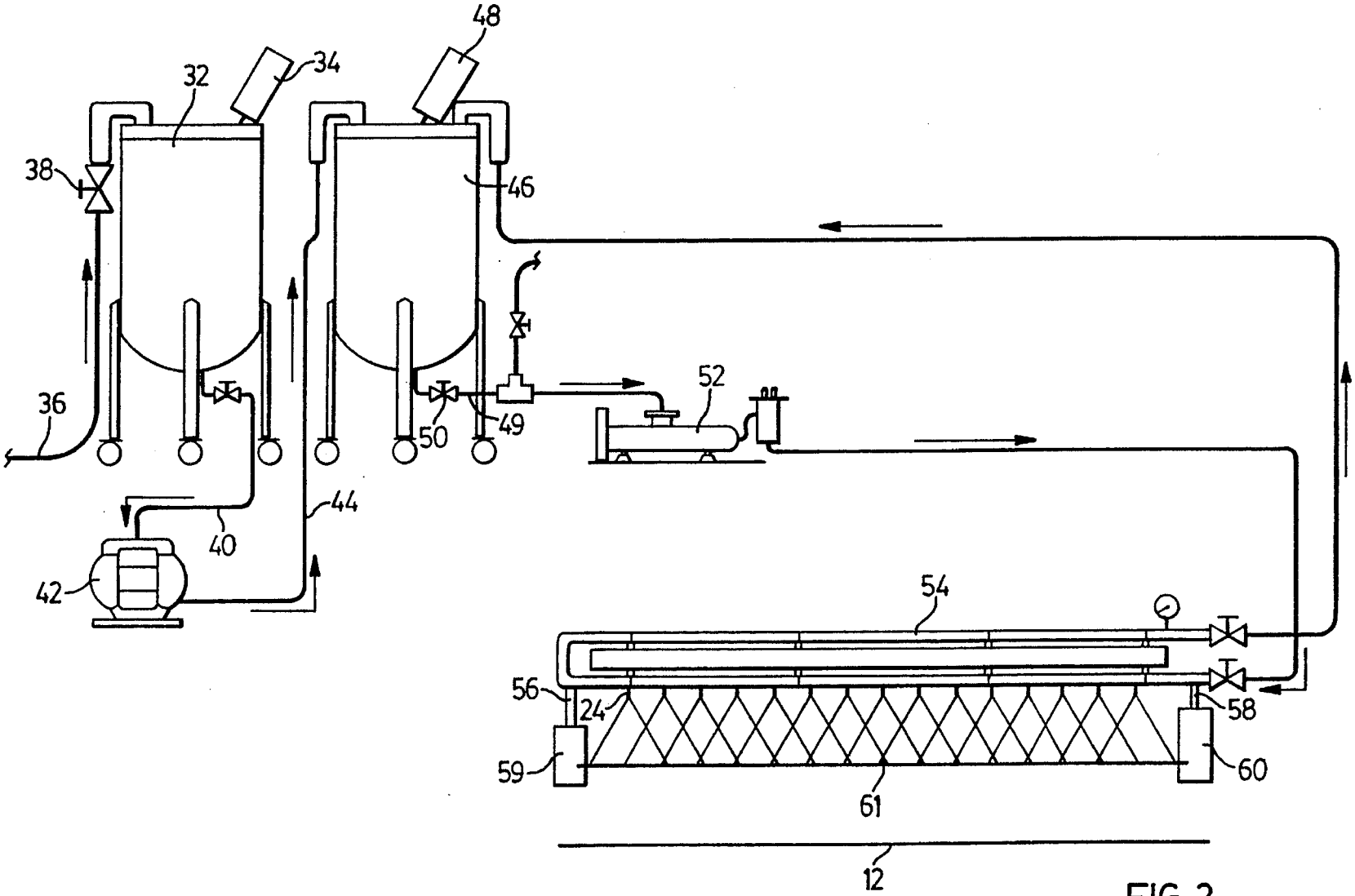
FIG. 2 is a schematic drawing showing an apparatus according to an embodiment of the invention.

FIG. 2 is a schematic representation showing further detail of an apparatus according to an embodiment of the invention. Reference numeral 32 indicates a mixing tank in which the fluid comprising the coating material, to be applied to the web of paper, is mixed to the desired composition by a first mixer 34. Water is fed into the mixing tank through water feed line 36 and water intake is limited by regulator valve 38.

As hereinbefore mentioned, the coating fluid may contain from about 0.1 to 50 percent solids, preferably 5 to 30 percent. Suitable coating materials are well known in the paper making art and include starch, clay, diatomaceous earth, silica, bentonite mineral or organic pigment, dyes, sizing, filler, binder, latex, polyvinyl alcohol, lime, metallic oxides, glycerine, glycols, invert sugar, magnesium salts, waxes, glues, gums, oils, rubber, boric acid, alginates, casein, carboxymethylcellulose, polymers or fluorocarbons. Selection of suitable coating materials and their concentration will depend on the desired characteristics which are to be imparted to the final pulp product. For example, for a waterproof coating, materials such as waxes, glues, gums, mineral oils, rubber or aluminum salts may be selected. Aqueous emulsions, suspensions or solutions of polymers may be used to improve paper qualities such as sheet strength, print quality, smoothness, gloss, resistance to wetting or porosity. Fluorocarbons may be used for resistance to grease and oil penetration and dyes or pigments may be used for colouring the paper substrate.

The mixed coating fluid drains from mixing tank 32 via mixing tank drainage line 40 and is pumped by pump 42 through run tank inlet 44 into run tank 46, equipped with, run tank mixer 48 to maintain the solids in suspension or solution. Coating fluid drains from run tank 46 through run tank drainage hose 49, equipped with regulator valve 50 to supply pump 52 which supplies coating fluid to spray boom 54. Spray boom 54 is supported on brackets 56 and 58 connected to opposite sides 59 and 60 of the machine frame.

It will be appreciated that the spray boom may be supported on the frame by a variety of support means other than the brackets shown in FIG. 2. Optionally, the spray boom may be mounted independently of the paper machine so as to avoid the effects from the shaking of the wire. By way of example, the spray boom may be suspended above the wire on hooks or pulleys or anchored to the floor. Preferably, the support means should be readily adjustable to lower or raise the spray boom and adjust the angle as required for a range of applications.

The high volume low pressure spray guns may be mounted at an angle to the web of pulp product whereby the spray of coating material is applied to the web of pulp product. Most preferably, the support means should be adjustable to alter the angle of the high volume low pressure spray guns relative to the web of pulp product between a range of 10° to 170°, preferably 70° to 111° most preferably about 90°. It will also be appreciated that the spray boom may be supported downstream from the forming section of the machine, where it may be located above or below the web of pulp product.

The high volume low pressure spray guns 24 are supported by spray boom 54 in series across the width of wire 12, preferably in equidistant relationship to each other. In order to achieve a thorough, complete coverage, the high volume low pressure spray guns are preferably spaced apart such that the edge of each fan of atomized spray mist intersects the mid point of the adjacent fan, as illustrated at reference numeral 61 in FIG. 2. For example, the high volume low pressure spray guns may be spaced apart 2 to 12 inches, preferably 3 to 6, most preferably about 4 inches.

A wide range of high volume low pressure spray guns may be employed in the present invention to supply a high volume low velocity atomized spray mist. Suitable guns include those commonly used in spray painting or refinishing applications, particularly for spray painting cars. Suitable guns include the Mach 1A HVLP Spray Gun (Binks Manufacturing Co. Franklin Park, Ill.) and the AGVX-HVLP spray gun (Devilbiss-Ransburg, Maunee, Ohio). High volume low pressure guns are those spray guns which permit the coating fluid to be delivered to the gun at low hydraulic pressures, for example 1–200 psi, preferably 1–50 psi, most preferably 1–20 psi. The fluid is atomized by introducing high volume low pressure air into the flow exiting the nozzle tip to provide a finely atomized soft spray. The Mach 1A HVLP airspray gun is fitted with special nozzles and modifications to allow a high transfer efficiency. High pressure, low volume airflow is converted to high volume, low pressure within the gun body. Special air and fluid nozzles enable the gun to atomize fluid at low air pressures and velocities, creating the "soft spray" effect for high transfer efficiencies.

Droplet sizes in the finely atomized spray mist may range from 1 to 1,200 micrometres, preferably from about 1 to 300, more preferably 1 to 200, micrometres. Exiting air pressures from the spray nozzle tip of 0.1 to 10, preferably 3 to 6 psig are suitable for applying a film of coating to the web of paper on the moving wire. Suitable paper speeds include the full range of speeds at which standard paper machines are operated, for example in a range of from 400 to 5,000 fpm, preferably 800 to 2,200 fpm.

Figure 3:
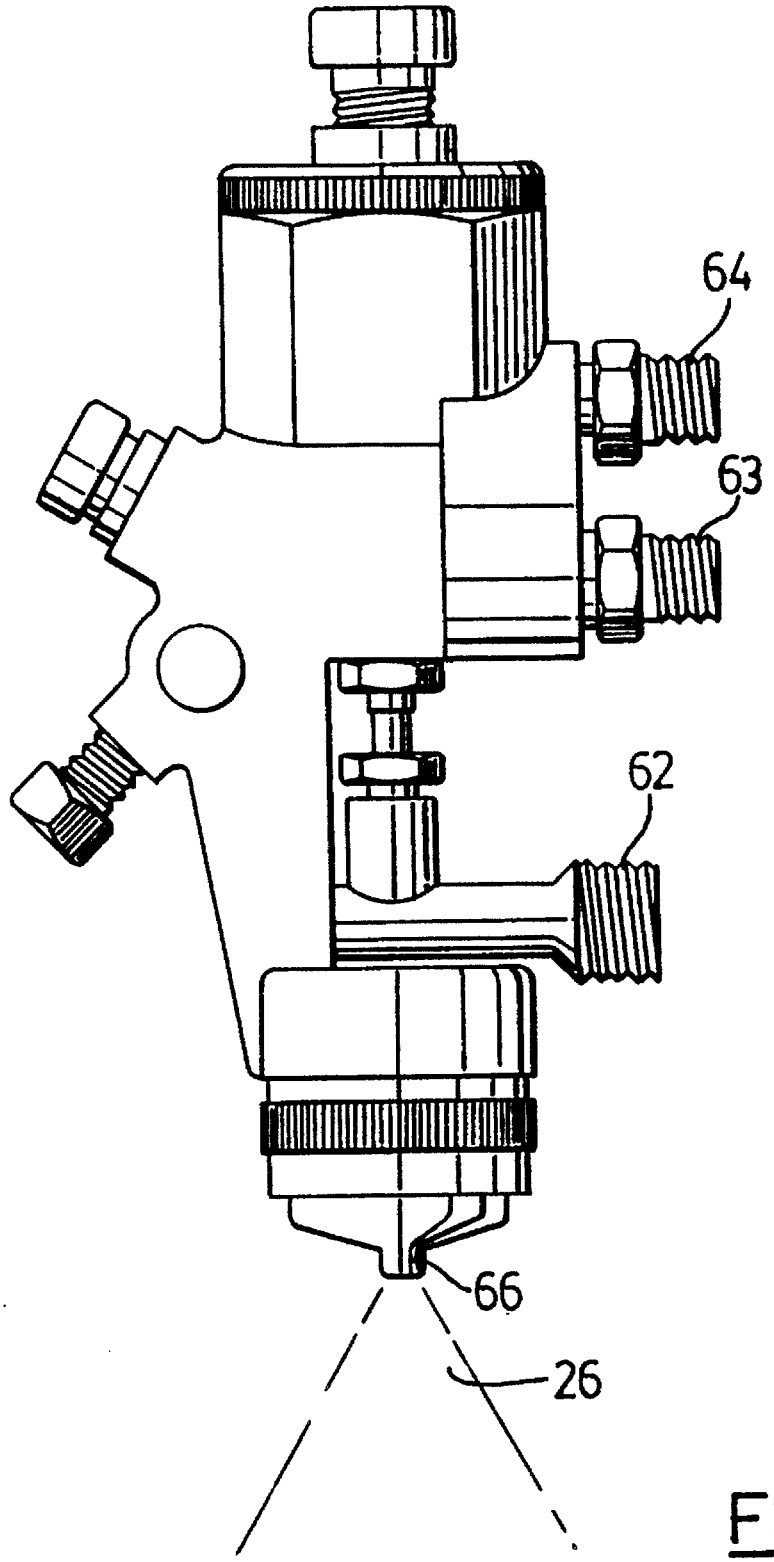
FIG. 3 is a schematic drawing of a high volume low pressure spray gun.

A suitable high volume low pressure spray gun is shown in FIG. 3. Coating material is supplied to the spray gun through fluid inlet 62 and air is supplied through atomizing air inlet 63. Actuating air inlet 64 provides a flow of actuating air which serves to actuate a trigger, to turn the high volume low pressure spray gun on and off. The atomized spray mist of coating fluid is dispersed from spray nozzle 66. The air source for the high volume low pressure spray gun may be a turbine generator capable of generating air at a pressure of from about 0.1 to 10 psig more preferably 3 to 6 psig, for directly supplying the guns with high volume low pressure air. The air source may also be compressed air, and additional converting means, such as restricted air flow, may be provided to convert the compressed air into high volume low pressure air.

Figure 4:
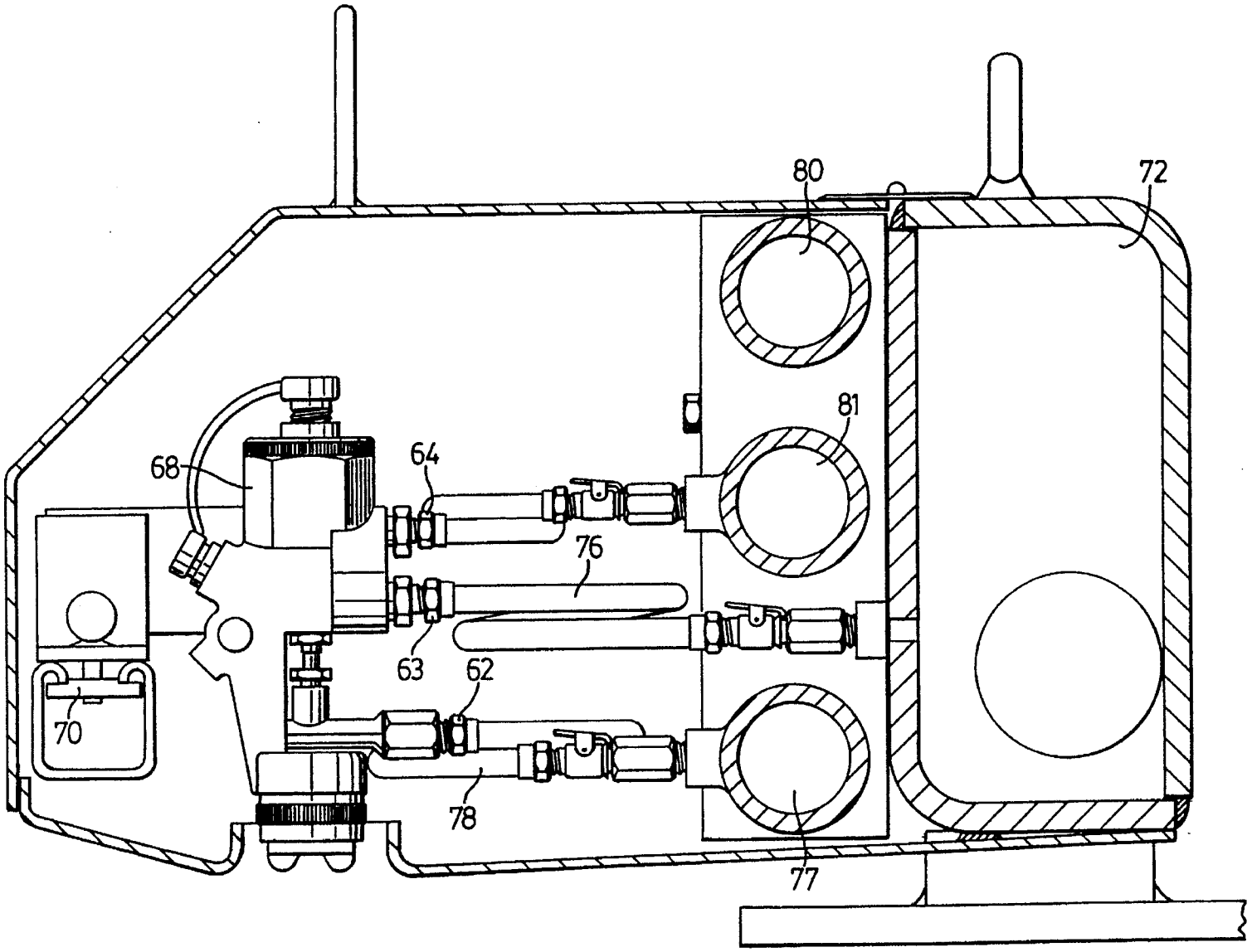
FIG. 4 is a cross sectional view through a spray boom supporting an array of high volume low pressure spray guns.

FIG. 4 shows a cross section through an embodiment of spray boom 54. The high volume low pressure atomising air is supplied in spray boom compartment 72 and is fed to atomizing air inlet 63 of spray gun 68 along atomising air tubing 76. Coating fluid is supplied by fluid intake 77 to fluid inlet 62 along fluid supply tubing 78. Coating fluid is recirculated through fluid recirculation outlet 80. Actuating air to turn high volume low pressure spray gun 68 on and off is supplied by actuating air line 81 to actuating inlet 64. High volume low pressure spray gun 68 is supported by spray gun support 70, in such a fashion that individual guns can be easily removed or adjusted for cross-machine positioning. To change the angle of spray relative to the web of pulp product, the complete boom assembly can be adjusted to an appropriate angle.

It is an advantage of the method and apparatus of the invention, that an integrated film of coating may be evenly applied across the width of the web of pulp product.

It is a further advantage of the present invention that the reduced air pressure at the spray gun reduces the velocity of the air stream and atomized fluid, which in turn reduces the bounce back of spray, resulting in a high transfer efficiency of coating fluid to the web of pulp product. Thus the present invention provides an efficient coating method which reduces loss of coating material and which also reduces pollution and contamination of the machine and surrounding environment. The present invention contemplates transfer efficiencies greater than 70 percent, preferably over 90 per cent, more preferably in the range of from 90 to 100 per cent.

It is also a further advantage of the method and apparatus of the present invention that it can be adapted to an existing standard paper machine, such as a fourdrinier, double wire or cylinder machine easily with only minor expenditures of time and effort and without the need for any additional floor space. For example, the apparatus may be manufactured and installed within four to six weeks without requiring any major modifications to the existing equipment.

Yet a further advantage is provided by the flexibility of the apparatus and method of the invention, which may be easily modified to suit a range of applications and pulp products with minimal machine shut down time.

The term pulp product as used herein includes a range of paper, paper board and cardboard such as tissue, glassine paper, light weight coated and machine finished paper, high quality newsprint, groundwood specialties, imitation parchment, paper board, bristol board, cardboard, linerboard and corrugated paper. The application of the invention to many types of pulp products for a variety of applications will be recognized.

A wide range of pulp stocks may be employed in the methods of the invention. Pulp stock may be selected based on the desired properties of the finished pulp product. Pulp stock may contain fibres such as those derived from wood, plant material, cotton, hemp, grasses, synthetic organic and inorganic sources including cellulose, nylon, polyester, polyvinyl chloride, acrylic, glass, ceramic, metal fibres and natural inorganic fibres such as asbestos.

The placement of the high volume low pressure spray guns may be varied through a range of positions within the forming section of the machine or downstream of the forming section. For example, the high volume low pressure spray guns may be placed at a position from the downstream end of the drainage units to Just upstream of the suction couch roll. The high volume low pressure spray guns may also be positioned between the suction couch roll and presses, between the presses and dryers or in the dryer section.

It will be appreciated that high volume low pressure spray guns located in the forming section of the machine may be positioned above the screen to apply a coating on the upper surface of the web of pulp product. Spray guns located downstream of the forming section on the machine, where the web of pulp product is no longer supported on the screen, may be positioned either above or below the web of pulp product to apply a coating to the upper or lower surface of the web of pulp product. For preparing a product coated on both upper and lower surfaces, the upper coat may be applied in the forming section of the machine or downstream of this section and the lower coat may be applied downstream of the forming section. In this case, the coating may be applied between the suction couch roll and the presses, between the presses and dryers or in the dryer section.

One application of the method and apparatus of the invention is to spray a high volume low velocity atomized mist of cooked or uncooked starch onto a web of paper to reduce linting of the paper in an offset printing press. The film of starch acts as a glue to stick loose material on the paper's surface to the rest of the sheet. This in turn prevents the loose material from coming off as the paper moves through the printing press.

EXAMPLE

Trials were performed on a fourdrinier newsprint machine running at a speed of about 1800 fpm. A groundwood paper pulp stock was used (70% stone groundwood, 30% high yield sulphite). The coating fluid contained 4.8 per cent uncooked modified (ethylated) starch solids in solution in water. Coating fluid was supplied to 8 Mach 1A HVLP spray guns (Binks Manufacturing Co.) mounted on a spray boom generally as shown in FIGS. 2 and 4 to provide approximately 32" total coverage. The boom was positioned above the wire just upstream of the suction couch roll in the forming section of the machine. The nozzles were positioned approximately 6 inches above the wire and spray was directed at an angle of 90° to the wire. Coating fluid was delivered to the guns at a pressure of 6 psi and atomising air was supplied from a compressor at a pressure of 60 psi and converted within the spray gun body to high volume low pressure air exiting the spray gun at approximately 5 psi.

The coated paper web was pressed, dried, calendered and reeled into rolls. A one hundred per cent transfer efficiency of starch solids onto the sprayed section of the web was achieved, as determined by measuring actual solids in solution and flow rates compared with weight of coating on the final sheet. An even, complete coverage of the sprayed section of the web was obtained, without spotting, as visualised by spraying the coated web with an aqueous iodine solution. The thorough coverage obtained provided a 60 per cent reduction in lint on the surface of the paper compared to uncoated controls as measured by the Apollo Lint test, a method used to determine the ability of the paper surface to retain fibre.

Having illustrated and described the principles of the invention in particular embodiments, it will be appreciated that the invention is by no means limited to the particular embodiments which are provided herein by way of example only. Numerous modifications may be made to the method and apparatus described without departing from the principles of the invention described in the following claims.

We claim:

1. A method of applying a film of coating material to a web of pulp product on a machine having a screen for forming a web of pulp product comprising the steps of:

(a) depositing a slurry of pulp stock on the screen of the machine;

(b) draining an initial amount of water through the screen, thereby forming the slurry of pulp stock into a web of pulp product on the screen;

(c) applying suction to remove further water from the web of pulp product on the screen;

(d) directing a fluid comprising the coating material against the surface of the web of pulp product on the screen in the form of a high volume low velocity atomized spray mist, wherein the spray mist is provided by a high volume low pressure spray gun having an exit pressure from the gun of from 0.1 to 10 psig, whereby a film of coating material is deposited on the web of pulp product in the machine.

2. A method as claimed in claim 1 wherein, in step (d), suction is simultaneously applied to remove still further water from the web of pulp product on the screen.

3. A method as claimed in claim 1 wherein the pulp product is paper.

4. A method as claimed in claim 1 wherein, the screen is a fourdrinier wire, a double wire or a cylinder.

5. A method as claimed in claim 1 wherein the air is at a pressure of from about 3 to 6 psig.

6. A method of applying a film of coating material to the surface of a web of pulp product on a paper machine comprising the steps of:

(a) forming a web of pulp product on the surface of a moving screen of a paper machine, (b) draining water from the web, (c) flowing a liquid coating material through at least one high volume low pressure spray gun and introducing air at a pressure of from 0.1 to 10.0 psig into the flow exiting the spray gun to provide an atomized spray mist of coating material, and (d) directing the atomized spray mist against the surface of the web of pulp product to form a film of coating material on the surface of the web of pulp product.

7. A method as claimed in claim 6 wherein, step (b) comprises the additional step of applying a vacuum to the undersurface of the screen to remove further water from the web.

8. A method as claimed in claim 7 wherein, in step (d), the atomized spray mist is directed against the web of pulp product between where the vacuum is first applied to the screen and a suction couch roll.

9. A method as claimed in claim 8 wherein, in step (d), vacuum is simultaneously applied to the undersurface of the screen to remove water from the web of pulp product on the screen.

10. A method as claimed in claim 6 wherein the pulp product is paper.

11. A method as claimed in claim 6 wherein, the screen is a fourdrinier wire, a double wire or a cylinder.

12. A method as claimed in claim 6, wherein step (b) further comprises: passing the web of pulp product over a suction couch roll and; peeling the web of pulp product off the screen.

13. A method as claimed in claim 12 wherein in step (d) the atomized spray mist is directed against the surface or undersurface of the peeled web between the suction couch roll and a press, between the press and a dryer section or, in the dryer section of the paper machine.

14. A method as claimed in claim 6 wherein the atomized spray mist of coating material is deposited on the web of pulp product with a transfer efficiency of over 70 per cent.

15. A method as claimed in claim 6 wherein the atomized spray mist of coating material is deposited on the web of pulp product with a transfer efficiency of from 90 to 100 per cent.

16. Apparatus for applying a film of coating material to a surface of a web of pulp product on a paper machine having a moving screen and vacuum drainage means, the apparatus comprising: support means positioned downstream from the vacuum drainage means on the machine adjacent to the web of pulp product and extending across the width of the web of pulp product; a plurality of high volume low pressure spray guns positioned on the support having means to introduce air at pressure of from 0.1–10 psig into a liquid spray exiting the spray guns and; means for supplying a fluid comprising coating material to the spray guns.

17. Apparatus as claimed in claim 16 wherein said support means comprises a spray boom supporting the plurality of spray guns in alignment transverse to the direction of movement of the web of paper.

18. Apparatus as claimed in claim 16 wherein the coating material is deposited on the web of the pulp product with a transfer efficiency of over 70 percent.

19. Apparatus as claimed in claim 18 wherein the coating material is deposited on the web of the pulp product with a transfer efficiency of between 90 and 100 percent.

20. Apparatus as claimed in claim 16 wherein the spray guns have an exiting air pressure from the spray nozzle tip of from about 3 to 6 psig.

21. Apparatus as claimed in claim 16 wherein the pulp product is paper.

22. Apparatus for applying a film of coating material to a surface of a web of pulp product on a paper machine having a moving screen, comprising: means for forming a web of pulp product on the surface of the moving screen; drainage means to remove water from the web; a high volume low pressure spray gun, having means to introduce air at a pressure of from 0.1 to 10.0 psig into a liquid spray exiting the spray gun, to provide an atomized spray mist; wherein the spray gun is positioned adjacent to the web of pulp product downstream from the drainage means, for directing the atomized spray mist against a surface of the web of pulp product to form a film of coating material on the web of pulp product.

23. Apparatus as claimed in claim 22 wherein the pulp product is paper.

* * * * *